United States Patent [19]

Sielck et al.

[11] Patent Number: 4,733,674

[45] Date of Patent: Mar. 29, 1988

[54] CIGAR VENTILATING DEVICE

[76] Inventors: Henry A. Sielck, 7049 Wilson Ter., Morton Grove, Ill. 60053; Edward R. Anton, 110 Harvey Ave., Grayslake, Ill. 60030

[21] Appl. No.: 6,240

[22] Filed: Jan. 22, 1987

[51] Int. Cl.[4] ..... A24F 13/24

[52] U.S. Cl. ..... 131/255; 131/254

[58] Field of Search ..... 131/254, 255; 604/227

[56] References Cited

U.S. PATENT DOCUMENTS

| | | | |
|---|---|---|---|
| 376,511 | 1/1888 | Carter | 131/255 |
| 744,893 | 11/1903 | Bailey | 131/255 |
| 894,858 | 8/1908 | Singley | 131/254 |
| 2,843,135 | 7/1958 | Lisiewski | 131/255 |
| 3,316,909 | 5/1967 | Cowley | 604/227 |

*Primary Examiner*—Vincent Millin

*Attorney, Agent, or Firm*—Neuman, Williams, Anderson & Olson

[57] ABSTRACT

A cigar ventilating device as provided which includes a projectile having a forward end formed by a conical end portion and a cylindrical portion there behind with a definite but low angle of flare adapted to enter a cigar and form a hole therein when positioned in a socket at the forward end of the device. An actuating member at the rear end of the device is engageable by the thumb of the user while the index and middle fingers of the user engage in an annular groove at the forward end of the device, a coiled compression return spring being provided on the inside of the device.

8 Claims, 5 Drawing Figures

5
5
10
11
12
13
14
15
16
18
20
21
22
23
24
25
26
27
28
29
30
31
32
33
34
35

CIGAR VENTILATING DEVICE

This invention relates to a cigar ventilating device and more particularly to a cigar ventilating device which may be safely carried in the pocket of the user and which is readily operable to form a hole in the end of a cigar without producing any unpleasant loose tobacco, the hole being clean and of a size such as to facilitate a smooth and easy draw of smoke from the cigar. The device has a small number of parts which are easily assembled and it is otherwise readily and economically manufacturable while being reliable in operation and very durable.

BACKGROUND OF THE INVENTION

A number of devices have heretofore been proposed for forming holes in the ends of cigars, various types of devices being disclosed in U.S. Patents including the Hayden Pat. No. 258,919, the Todd, Jr. Pat. No. 703,162, the Bailey Pat. No. 744,893, the Stephens Pat. No. 889,556, the Singley Pat. No. 894,858, the Benson Pat. No. 1,284,566, the Giacopini Pat. No. 1,734,620 and the Lisiewski Pat. No. 2,843,135.

So far as is known, none of the devices as heretofore proposed are commercially available and it is believed that such is the case because it appears that they would have problems with respect to obtaining satisfactory operation and also with respect to manufacture thereof.

SUMMARY OF THE INVENTION

This invention was evolved with the general object of providing an improved cigar ventilating device capable of forming a hole such as to obtain smooth and easy draw without producing objectional loose tobacco and which is easy to operate while also being inexpensively manufacturable.

Important aspects of the invention relate to the discovery of problems with prior art types of construction and to experimental efforts leading to the recognition of the sources of such problems. In a device constructed in accordance with the invention, the end of a cigar is inserted into a guide socket which is provided at the forward end of a support body and an actuating element at the opposite end of the body is moved forwardly to move a piercing element into the end of the cigar, acting against a return spring. The index finger might be used for operation of the actuating element while holding the support body between the thumb and index finger. However, it is found that there are problems and that operation is much easier and that more accurate control is obtained when the thumb is used for engaging the actuating element and when, in addition, means are provided for securely holding the body portion with the index and middle fingers.

In accordance with an important feature of the invention, a pair of annular collar portions are provided at the forward end of the device, spaced apart a distance to define an annular groove which is preferably of smoothly rounded form. The groove has a width sufficient for entry of the index and middle fingers into diametrically opposite sides thereof and has a depth sufficient to permit the body portion to be securely held during use of the thumb to provide the actuating force.

In accordance with another feature of the invention, the support body has inwardly projecting annular portions to define two shoulders, one being engageable with a rearwardly facing shoulder of a plunger or projectile to limit rearward movement thereof and the other being engaged by the forward end of a coiled spring which has a rearward end engaged with an actuating element secured to the rear end of the projectile. Preferably, a threaded connection is provided between the rear end of the projectile and the actuating element. The device is readily constructed from a minimum number of components and is easily assembled.

A further feature relates to the provision of a sleeve portion extending forwardly from the actuating element to extend on the outside of a rearward end portion of the support body, also facilitating assembly while accurately guiding movement and obtaining smooth operation.

Another important feature relates to the construction of the forward end portion of the plunger or projectile to provide highly efficient and effective piercing means. In accordance with this feature, a forward conical end portion is provided which has a relatively high angle of flare and a cylindrical portion having a definite but low angle of flare extends back from the rear end of the forward conical end portion. As the projectile is moved forwardly, the conical portion initially forms a hole which has a diameter equal to that of the junction between the rearward end of the conical portion and the forward end of the cylindrical portion. Then, with continued forward movement, a passage is formed in the cigar in communication with the hole. The definite but low angle of flare of the cylindrical portion causes the tobacco to be gradually pressed outwardly and causes the diameter of the hole to be gradually enlarged, during forward movement. During rearward movement, it allows the surface of the cylindrical portion to be readily separated from the tobacco, with minimum friction. The result is that no loose tobacco is withdrawn through the hole and the hole and passage are so formed as to obtain a smooth and easy draw.

This invention contemplates other objects, features and advantages which will become more fully apparent from the following detailed description taken in conjunction with the accompanying drawings.

DESCRIPTION OF A PREFERRED EMBODIMENT

Figures 1, 2, 3, 4, 5:
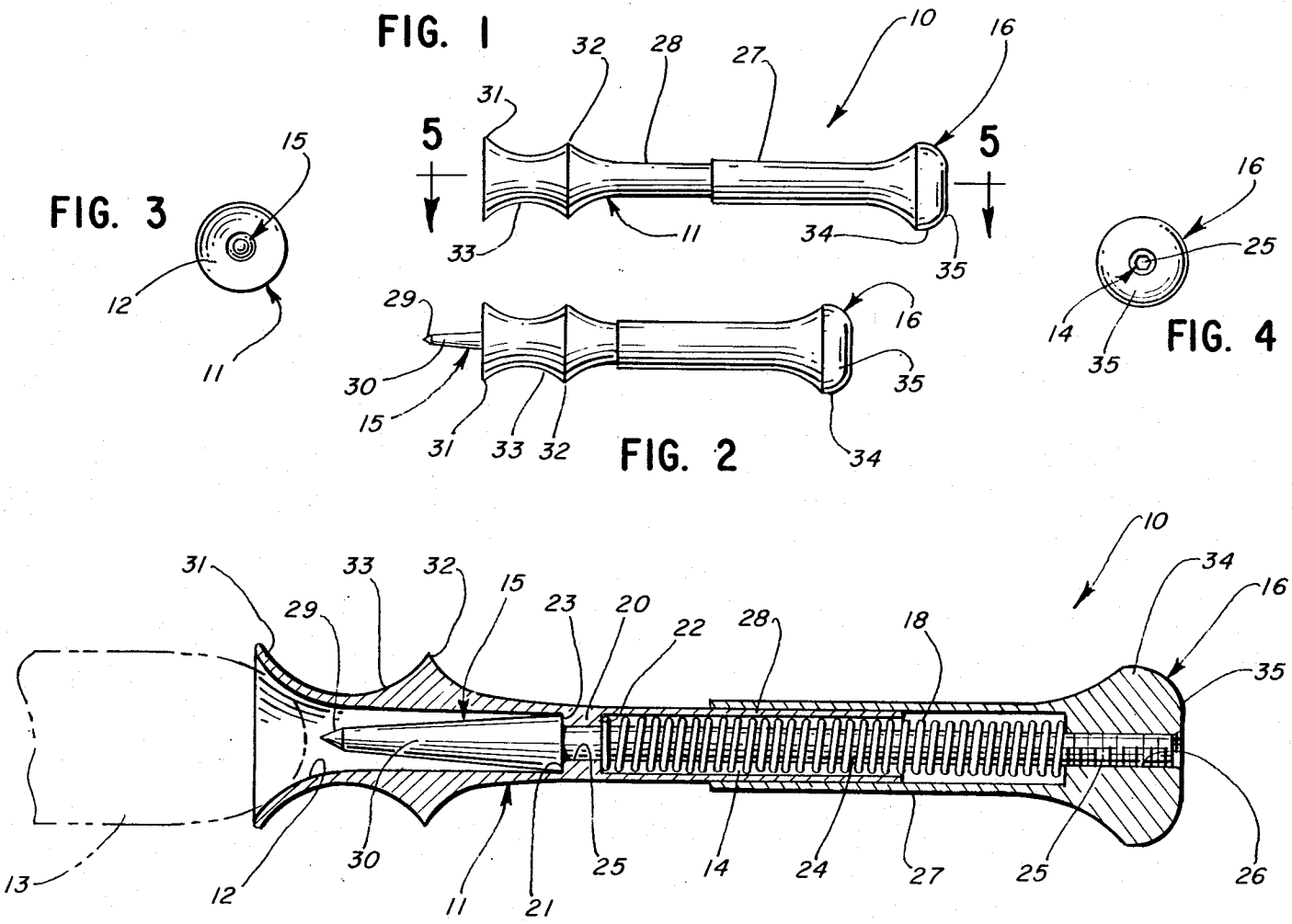
FIG. 1 is a top plan view of a cigar ventilating device constructed in accordance with the principles of this invention.
FIG. 2 is a view like FIG. 1 but illustrating the device in fully actuated condition.
FIG. 3 is a forward end view of the device of FIG. 1.
FIG. 4 is a rearward end view of the device of FIG. 1.
FIG. 5 is a sectional view, on an enlarged scale, taken substantially along line V—V of FIG. 1.

Reference numeral 10 generally designates a cigar ventilating device constructed in accordance with the principles of the invention. It includes a body 11 which has a forward end formed with an inside surface portion 12 of generally conical shape (FIG. 5) to provide a socket for receiving and centering the end of a cigar 13 which is indicated in broken lines.

A plunger or projectile 14 is journaled for longitudinal movement within the body 11 and has a pointed forward end portion 15 for functioning as a piercing means to enter the end of the cigar and form a ventilating hole and passage therein. An actuating member 16 is secured to the rearward end of the projectile 14 and a coiled compression spring 18 operates between the body 11 and actuating member 16 to urge the actuating member 16 and projectile to a rearward position with the pointed forward end portion 15 retracted within the socket-defining surface portion 12 so as to prevent contact with the fingers, clothing or other things. The device may thus be safely carried within a pocket or the like.

Before use, the end of the cigar 13 may preferably be wetted. When the actuating member 16 is then moved forwardly relative to the body 11 and cigar 13 to a position as shown in FIG. 2, the forward end portion 15 is moved forwardly to enter the end of the cigar 13 and to form a hole and ventilating passage therein. Upon release, the spring 18 moves the member 16 and projectile 14 back to the position of FIG. 1.

In accordance with an important feature of the invention, the support body 11 has an internal inwardly projecting annular portion 20 to define a forwardly facing shoulder 21 and a rearwardly facing shoulder 22. Shoulder 21 is engageable with a rearwardly facing shoulder 23 of the plunger or projectile 14 to limit rearward movement thereof and shoulder 22 is engaged by the forward end of the coiled compression spring 18 which has its rearward end engaged with the actuating member 16 secured to the rear end of the projectile. Preferably, the projectile has a rod portion 24 behind the shoulder 23 which is of uniform diameter and which is dimensioned to provide a slide fit with an internal cylindrical surface 25 of the portion 20. A rearward terminal end portion 25 of the rod portion 24 is threaded and the actuating member 16 is provided with an internally threaded opening 26 so that the actuating member 16 may be screwed thereon in assembly, after inserting the rod portion 24 of the projectile 14 in from the forward end and after then inserting the spring 18 in from the rearward end. A construction is thus provided which is such that the device is readily made from a minimum number of components and is easily assembled. After assembly, the actuating member 16 may be tack-welded or otherwise permanently secured to the projectile, if desired A further feature relates to the provision of a sleeve portion 27 extending forwardly from the actuating member 16, preferably as an integral part thereof, and having a diameter such as to extend on the outside of a rearwardly extending sleeve portion 28 of the support body, also facilitating assembly while accurately guiding movement and obtaining smooth operation.

Another important feature relates to the construction of the forward end portion 15 of the plunger or projectile 14 to provide highly efficient and effective piercing means. In accordance with this feature, a forward conical end portion 29 is provided which has a relatively high angle of flare and a cylindrical portion 30 having a definite but low angle of flare extends back from the rear end of the forward conical end portion 29. As aforementioned, when the projectile 14 is moved forwardly, the conical portion 29 initially forms a hole which has a diameter equal to that of the junction between the rearward end of the conical portion and the forward end of the cylindrical portion. Then, with continued forward movement, a passage is formed in the cigar in communication with the hole. The definite but low angle of flare of the cylindrical portion 30 causes the tobacco to be gradually pressed outwardly and causes the diameter of the hole to be gradually enlarged, during forward movement. During rearward movement, it allows the surface of the cylindrical portion 30 to be readily separated from the tobacco, with minimum friction. The result is that no loose tobacco is withdrawn through the hole and the hole and passage are so formed as to obtain a smooth and easy draw.

It is important that the dimensions be proper, to obtain optimum results. Preferably, the angle of flare of the forward conical portion 29 is on the order of 25 degrees and it has an axial length of about 0.1 inches, the diameter at the rearward end of the conical portion 29, where it joins the forward end of the cylindrical portion 30, being about 0.8 inches. The cylindrical portion 30 may preferably have an angle of flare of about 5 degrees and a length of at least about 0.5 inches, preferably about 0.8 inches. It will be understood, of course, that the dimensions may be varied.

Another feature of the invention relates to the provision of a pair of annular power portions 31 and 32 on the forward end of the body 11 spaced axially apart a distance such as to form an annular groove 33 which is preferably of smoothly rounded form. The collar portion 31 is on the outside of the surface portion 12 which defines the socket for receiving the end of the cigar 13. The collar portions 31 and 32 are preferably of about equal diameter and the groove 33 has a width sufficient for entry of the index and middle fingers into diametrically opposite sides thereof, with a depth sufficient to permit the body 11 to be securely held during use of the thumb to apply an actuating force against the rear end of the actuating member. Preferably, the actuating member 16 has a rearward end portion 34 of enlarged diameter to provide an extended area 35 for engagement by the thumb.

With this arrangement, the movement of the forward end portion 15 into the end of a cigar may be accurately controlled and a hole and ventilating passage are so formed as to obtain a smooth and easy draw.

All of the parts of the device may be made of metal but it is possible to use other materials, particularly with respect to the body 11, projectile 14 and actuating member 16, which might be readily made from plastic, the configurations thereof being such that conventional injection molding operations may be readily used. Another type of connection might be a substitute for the illustrated threaded connection, especially when the parts are made from plastic.

By way of example and not by way of limitation, the axial distance between the apices of the annular collar portions 31 and 32 may be on the order of 0.6 inches. The overall length of the device, in the inactive condition shown in FIG. 1, may be about 3.3 inches. However, the length of the device may be reduced to provide a more compact size. It should also be noted that the device may be made larger and may be provided with or mounted on a base structure such that it could be supported on a desk of the user.

It will be understood that modifications and variations may be effected without departing from the spirit and scope of the novel concepts of this invention.

We claim:

1. A cigar ventilating device, comprising: support body means, guide socket means at a forward end of said support body means for receiving an end portion of a cigar, piercing means within said forward end of said support body means, actuating means connected to said piercing means to control movement of said piercing means in a forward piercing direction to enter and form a hole in a cigar end portion positioned in said guide socket means and then in an opposite rearward retracting direction to withdraw from the hole so formed, spring means for urging said piercing means and said actuating means in said rearward retracting direction, interengageable stop means associated with said piercing means and said support body for limiting movement of said piercing means and said actuating means in said rearward retracting direction, said actuating means being at a rearward end of said device and being engageable by the thumb of a user to move said piercing means in said forward actuating direction against the action of said spring means, an elongated projectile having a forward end portion forming said piercing means and having a rearwardly facing annular shoulder at the rear end of said piercing means, said support body means having a central passage receiving said projectile and including an annular portion which projects inwardly into said passage to provide forwardly and rearwardly facing annular shoulders, said interengageable stop means being formed by said rearwardly facing annular shoulder of said projectile and said forwardly facing annular shoulder of said body means, and said spring means comprising a coiled compression spring around a rearward portion of said projectile and having a forward end engaged with said rearwardly facing annular shoulder of said body means.

2. A cigar ventilating device as defined in claim 1, said elongated projectile having a cylindrical portion of uniform diameter extending rearwardly from said forward end portion thereof, and said inwardly projecting annular portion of said support body means having a diameter such as to provide a slide fit with said cylindrical portion of said projectile for accurately positioning said piercing means relative to said socket means and a cigar engaged in said socket means.

3. A cigar ventilating device as defined in claim 1, said projectile having a rearward externally threaded end portion, and said actuating means comprising a member having an annular surface portion engaged with the rearward end of said spring and having an internally threaded opening extending rearwardly from said annular surface portion and threaded onto said externally threaded end portion of said projectile in assembly of said device.

4. A cigar ventilating device as defined in claim 3, said member of said actuating means including a sleeve portion extending forwardly from the outside of said annular surface portion to provide an internal cylindrical guide surface, and said body means having an external cylindrical guide surface within said internal cylindrical guide surface of said sleeve portion to guide said projectile during forward and rearward movement thereof.

5. A cigar ventilating device as defined in claim 4, said elongated projectile having a cylindrical portion of uniform diameter extending rearwardly from said forward end portion thereof, and said inwardly projecting annular portion of said support body means having a diameter such as to provide a slide fit with said cylindrical portion of said projectile and to cooperate with said sleeve portion for accurately positioning said piercing means relative to said socket means and a cigar engaged in said socket means.

6. A cigar ventilating device as defined in claim 1, said piercing means comprising a forward conical end portion having a large angle of flare and a short axial dimension for entry into the end of a cigar to form an initial hole therein and a cylindrical portion of substantially greater axial length having a small angle of flare for gradually enlarging said hole and forming a tapered hole in the cigar, the angle of flare of said cylindrical portion being sufficient to facilitate withdrawal of said piercing means from said hole and leave a cleanly formed tapered passage in a cigar.

7. A cigar ventilating device as defined in claim 1, holding means at the forward end of said device and arranged for engagement by the index and middle fingers of a user, said holding means comprising first and second annular collar portions on the outside of said guide socket means, said second annular collar portion being spaced rearwardly from said first annular collar portion, said annular collar portions forming an annular groove therebetween for receiving the index and middle fingers of the user to allow the device to be firmly held and to facilitate accurate control of the movement of said piercing means by the thumb of the user.

8. A cigar ventilating device as defined in claim, 1, said socket means having an internal generally conical surface in coaxial relation to said piercing means and on the inside of said first annular collar portion.

* * * * *